United States Patent [19]

Tyler

[11] 4,064,426

[45] Dec. 20, 1977

[54] NIGHT LIGHT

[76] Inventor: Richard Tyler, 1777 Tiffany Court, Camarillo, Calif. 93010

[21] Appl. No.: 741,945

[22] Filed: Nov. 15, 1976

[51] Int. Cl.[2] ..... F21V 33/00

[52] U.S. Cl. ..... 362/226; 339/147 R

[58] Field of Search ..... 240/1 R, 2 R, 2 SP, 240/4.2, 10 R, 46.57, 52 R, 52.1, 73 QD, 151, 152, 153; 339/147 R, 147 P, 176 L

[56] References Cited

U.S. PATENT DOCUMENTS

| | | | |
|---|---|---|---|
| 2,050,438 | 8/1936 | Ludwig | 240/52.1 UX |
| 3,256,466 | 6/1966 | Trolio et al. | 339/147 R X |
| 3,489,891 | 1/1970 | Altissimo | 240/152 X |
| 3,641,481 | 2/1972 | Farrell | 339/176 L X |
| 3,818,212 | 6/1974 | Rochford et al. | 240/10 R |

*Primary Examiner*—Fred L. Braun
*Attorney, Agent, or Firm*—Pastoriza & Kelly

[57] ABSTRACT

An improved night light structure is arranged to be received directly in an electrical wall outlet and supported by the plug blades received in the outlet socket. The night light itself includes a capacitor in series with a miniature light bulb such that the voltage from the outlet is dropped in value by the capacitor so that the voltage across the bulb is substantially less than its normal voltage rating. As a result, the bulb can last for long periods in excess of ten years. Further, by utilizing a miniature bulb of relatively small voltage rating, should the capacitor short circuit, the bulb will immediately burn out and thus function as a fuse. A fail-safe night light is thus provided.

6 Claims, 3 Drawing Figures

NIGHT LIGHT

This invention relates generally to night lights and more particularly to night lights of the type that can be plugged directly into a wall outlet to provide a dim illumination during night-time for use in offices, residential homes, hotel rooms, bathrooms, and the like.

BACKGROUND OF THE INVENTION

Night lights for residential use for providing a dim illumination for corridors and the like are well known in the art. Generally, these lights are of two types: first, a low wattage bulb is energized directly from the voltage available at the electrical outlet. Second, a normal wattage light bulb for conventional illumination is utilized in conjunction with a series connected resistance or capacitor to effect dimming of the bulb and thus provide a desired dim illumination.

In the first of the above types, the normal 110-volts available at the electrial outlet is applied across the bulb. The wattage of the bulb is small to provide the desired dim illumination and towards this end, the current through the bulb is quite limited. Excess energy results in the generation of heat by the relatively high resistance of the filament. While these types of night lights serve their purpose, they suffer the disadvantage of all electrically operated light bulbs when energized directly from an electrical wall outlet in that, in addition to heat generation, the bulbs must be periodically replaced since their useful life is limited.

The second type of night lights wherein a capacitor or resistance is utilized in series with a conventional bulb provides certain advantages. First, the voltage across the bulb itself is substantially less than normal voltage rating of the bulb with the desired result of extremely long life. On the other hand, if a resistance is used in series with the bulb to provide the reduced voltage, heat is generated in the resistance and such can be an undesirable feature since heat itself over long periods of time tends to accelerate the deterioration of the housing and insulation on the wires. Where a capacitance is used to drop the voltage, the night light can run cool and also exhibits the advantage of extremely long life. On the other hand, should the capacitor short circuit or fail, the bulb itself will be illuminated to its fullest brightness and this result could be undesirable since again substantial heat will be generated and the life of the bulb will be substantially shortened. Further, depending upon the type of capacitor and failure therein, a relatively high current will be passing through the defective structure to energize the bulb and this could result in a fire hazard or other possible damage.

BRIEF DESCRIPTION OF THE PRESENT INVENTION

With the foregoing considerations in mind, the present invention contemplates an improved night light which exhibits the advantages of both of the foregoing basic types discussed but none of the disadvantages thereof.

More particularly, in accord with the present invention, there is provided a night light which utilizes a miniature bulb of a relatively low voltage rating connected in series with a capacitor all appropriately supported within a housing from which first and second plug blades extend for insertion directly into an electrical wall outlet.

The voltage and resistance rating of the light bulb and the value of the capacitor are all such that the voltage drop across the light bulb itself when the capacitor is in series therewith is substantially less than the rating of the light bulb so that desired long life is realized. Moreover, because of the fact that a miniature bulb is used with a fairly low voltage rating, should a short circuit occur in the capacitor, the full application of the electrical wall outlet voltage to the miniature light bulb will immediately burn it out thereby opening up all circuits. The light bulb thus functions as a fuse as well as a night light providing the desired dimmed illumination so that a fail-safe system results.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
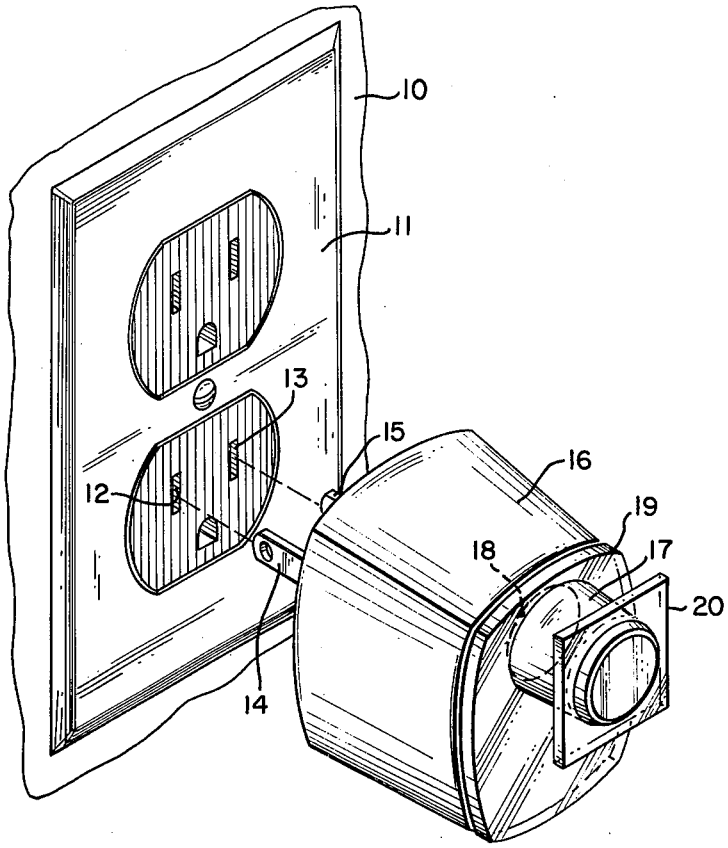
FIG. 1 is a perspective view of the night light of this invention preparatory to being received in a conventional wall outlet socket.

Referring first to FIG. 1 there is shown a wall 10 with a conventional electrical outlet 11. Normally, the outlet 11 provides double sockets so that more than one electrical appliance can be connected thereto. Thus, considering the lower socket portion, the outlet includes first and second blade receiving slots 12 and 13. In the United States, the conventional outlet of the type shown in FIG. 1 provides 110 volts at 60 Hertz.

The night light itself in accord with the present invention includes first and second blades 14 and 15 supported by a housing 16, the blades being receivable in the slots 12 and 13 and functioning to serve as the sole support for the night light which may be permanently left in the outlet. In this respect, the outlet may be in a bathroom or in the lower wall of a corridor or hallway.

As will become clearer as the description proceeds, the housing 16 incorporates a miniature light bulb and capacitor in series with the first and second blades 14 and 15. A truncated cone shaped translucent cover 17 overlies a front opening 18 in the housing 16 through which the bulb extends. This cover diffuses the light and thereby eliminates glare.

In FIG. 1, the night light has a flat mirror 19 having an opening registering with the opening 18 through which the bulb extends and covering the front face of the housing 16. This flat mirror will reflect light passing from the bulb through the translucent cover 17 as well as provide decorative effects. In addition, there may be provided a clear glass 20 of less area than the mirror 19 surrounding and supported by the translucent cover 17 as indicated at 20, the same being in parallel spaced relationship with respect to the mirror 19. This latter glass plate will conduct light and effect certain reflections relative to the mirror 19 and further adds aesthetic features to the overall night light. Actually, the mirror 19 and glass plate 20 are not essential features of this invention but are normally provided in the preferred embodiment.

Figure 2:
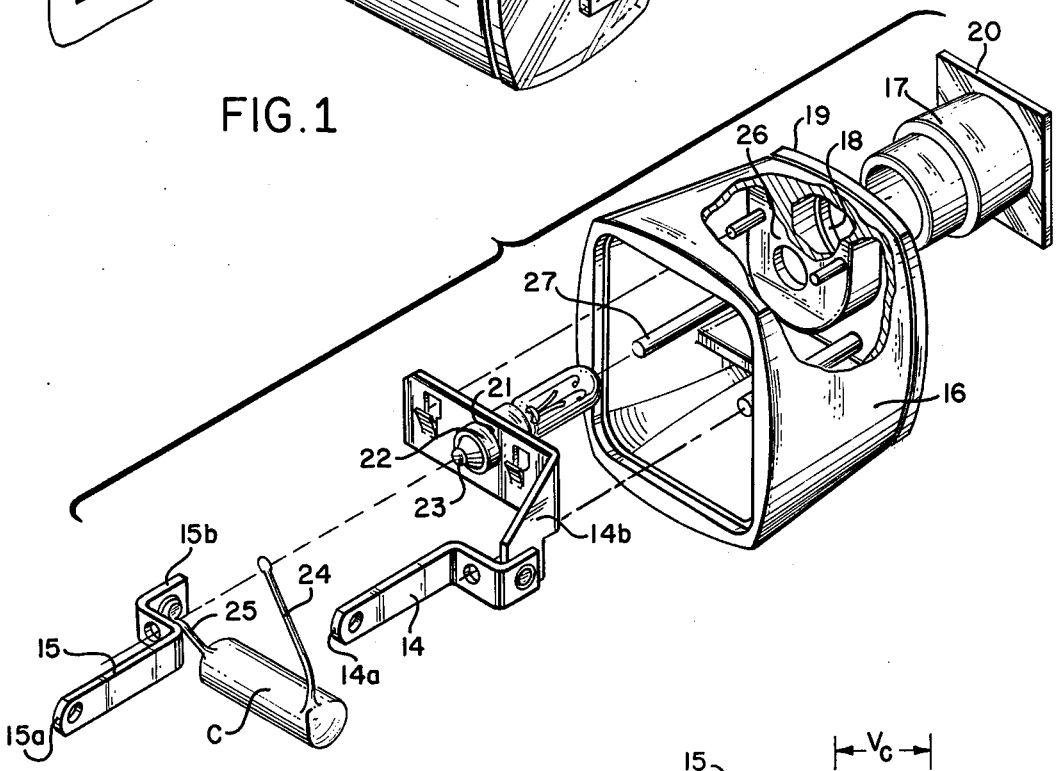
FIG. 2 is an exploded perspective view, partly broken away, illustrating the basic components making up the night light of FIG. 1.

Referring now to FIG. 2, details of the night light structure and circuit will be evident. Referring to the central portion of FIG. 2, it will be noted that the first conducting blade 14 has one end 14*a* receivable in the slot 12 of FIG. 1 and its other end terminating in an electrically conducting frame structure 14*b* defining a bulb supporting opening 21. The light bulb itself is indicated at L and includes an annular base terminal 22 and an end terminal 23, the base terminal being received and permanently supported in the opening 21 of the frame structure 14*b*. This frame structure is electrically conducting so that the base terminal is electrically connected to the first blade 14.

The second conducting blade 15 has one end 15*a* receivable in the second of the receiving slots as shown at 13 in FIG. 1 and its other end terminating in an electrical terminal 15*b*.

The electrical portion of the night light is completed by the provision of a capacitor C having first and second terminal leads 24 and 25 permanently electrically connected respectively to the end terminal 23 of the light bulb L and the electrical terminal 15*b* of the second blade 15. In FIG. 2, the second blade structure is shown in exploded away from the light bulb L but it will be understood that the free end of the terminal lead 24 is permanently soldered directly to the end terminal 23 of the bulb L.

The housing 16 itself as shown in FIG. 2 is of insulating material and incorporates interior supports 26 and 27 for holding the first and second blades 14 and 15 in fixed parallel relationship. The positioning of these interior supports is such that the light bulb L will pass through the front opening 18 of the housing 16 as shown in the broken away portion of FIG. 2 to pass into the translucent cover 17 described in FIG. 1, this cover 17 being shown exploded away from the front of the housing.

In FIG. 2 there is also shown the flat mirror 19 which may simply be glued to the front of the housing 16 and the additional glass plate 20 of smaller area held adjacent to the far end of the translucent cover 17.

Figure 3:
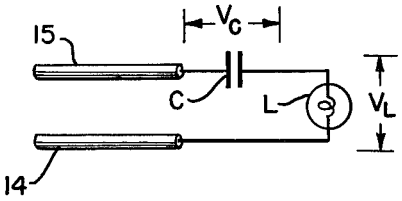
FIG. 3 is a simple electrical diagram of the night light.

FIG. 3 shows schematically the electrical circuit of the night light wherein it will be noted that the blades 14 and 15 include the lamp L and the capacitor C in a series circuit. The voltage drop across the capacitor C is indicated at Vc while the voltage drop across the light bulb L is indicated at $V_L$.

In accord with a salient feature of this invention, the light bulb L has a filament of given resistance and voltage rating substantially less than the voltage at the electrical outlet such that it will burn out in the event the capacitor C should short circuit so that the light bulb simultaneously functions as a night light providing dimmed illumination and a fuse.

In accord with this invention, the contemplated given resistance and voltage rating of the bulb L may vary from 10 to 240 ohms and from 3.2 to 55 volts respectively, the capacitor having a capacitance of from 0.68 microfarads to 3.0 microfarads. Appropriate values within these ranges are such that the voltage across the bulb $V_L$ is always less than the voltage rating of the bulb filament.

In the preferred embodiment of the invention, the various values, within a variation of plus or minus five percent, are as follows: the given resistance and voltage rating of the bulb is 125 ohms and 28 volts respectively. The capacitor has a capacitance of 1.15 microfarads. The voltage at the electrical outlet is 110 volts at a frequency of 60 Hertz. The voltage drops across the capacitor and light bulb, Vc and $V_L$ when the blades are received in the outlet are 89 volts and 21 volts, respectively.

Since the voltage rating of the miniature light bulb is 28 volts and only 21 volts is applied thereacross, it will last for an extremely long period of time, usually in excess of ten years. Further, by utilizing a miniature light bulb having a voltage rating substantially less than the voltage at the outlet supplying initial power to the night light, in combination with a capacitor of appropriate capacitance minimum heat is generated so that the structure remains relatively cool even though energized continuously.

Finally, and as emphasized heretofore, because of the particular values chosen, the light bulb functions as a fuse in the event the capacitor should become short-circuited thereby resulting in a night light having fail-safe characteristics.

From all of the foregoing, it will thus be evident that the present invention has provided a highly attractive and useful improved night light which avoids some of the disadvantages characteristic of presently available night lights.

I claim:

1. A night light for plugging directly into first and second blade receiving slots in an electrical wall outlet said night light comprising, in combination:

a. a first conducting blade having one end receivable in said first of said receiving slots and its other end terminating in an electrically conducting frame structure defining a bulb supporting opening;

b. a light bulb having an annular base terminal and an end terminal, said base terminal being received in and supported by said bulb supporting opening so that the base terminal is electrically connected to said frame structure and first blade;

c. a second conducting blade having one end receivable in said second of said receiving slots and its other end terminating in an electrical terminal;

d. a capacitor having first and second terminal leads permanently electrically connected respectively to said end terminal of said light bulb and said electrical terminal of said second blade; and e. a housing of electrical insulating material incorporating interior supports for holding said first and second blades in fixed parallel relationship, and having a front opening through which said bulb extends such that said night light is wholly supported by the blades when received in said electrical wall outlet, said bulb having a filament of given resistance and voltage rating substantially less than the voltage at said electrical outlet to burn out in the event such capacitor should short-circuit so that said light bulb simultaneously functions as a night light and as a fuse.

2. A night light according to claim 1, including a flat mirror affixed to the front of said housing having a central opening registering with said front opening of said housing through which said bulb extends for reflecting light from said light bulb.

3. A night light according to claim 2, further including a truncated cone shaped translucent cover secured to the front of said housing surrounding said light bulb; and a glass plate of smaller area than said mirror having a central opening receiving and being supported by said cover in parallel spaced relationship in front of said mirror.

4. A night light according to claim 1, in which said given resistance and voltage rating of said bulb is from 10 to 240 ohms and from 3.2 to 55-volts respectively, said capacitor having a capacitance of from 0.68 microfarads to 3.0 microfarads.

5. A night light according to claim 1, in which, within a variation of plus or minus five percent, the following values are obtained: said given resistance and voltage rating of said bulb is 125 ohms and 28 volts respectively, said capacitor has a capacitance of 1.15 microfarads, the voltage at said electrical outlet is 110 volts at a frequency of 60 Hertz, and the voltage drops across said capacitor and light bulb when said blades are received in said outlet are 89 volts and 21 volts respectively.

6. A night light according to claim 1, including a translucent cover surrounding said light bulb to eliminate glare.

* * * * *